United States Patent [19]

Forbis

[11] Patent Number: 5,040,301

[45] Date of Patent: Aug. 20, 1991

[54] REAR BOW SIGHT

[76] Inventor: Charles L. Forbis, P.O. Box 661, Quapaw, Okla. 74363

[21] Appl. No.: 475,015

[22] Filed: Feb. 5, 1990

[51] Int. Cl.[5] ..... F41G 1/467

[52] U.S. Cl. ..... 33/265; 124/87

[58] Field of Search ..... 33/265; 124/87, 88

[56] References Cited

U.S. PATENT DOCUMENTS

| | | | |
|---|---|---|---|
| 2,909,167 | 10/1959 | Fredrickson | 33/265 |
| 2,982,026 | 5/1961 | Peterson | 33/265 |
| 3,063,151 | 11/1962 | Hanson | 33/265 |
| 3,715,807 | 2/1973 | Heffer | 33/265 |
| 4,136,462 | 1/1979 | Topel | 33/265 |
| 4,162,579 | 7/1979 | James | 33/265 |
| 4,215,484 | 8/1980 | Lauffenburger | 33/265 |
| 4,332,231 | 6/1982 | Napier et al. | 124/87 |
| 4,494,313 | 1/1985 | Scott | 33/265 |
| 4,685,217 | 8/1987 | Shader | 33/265 |

*Primary Examiner*—Thomas B. Will

*Attorney, Agent, or Firm*—Dennis T. Griggs

[57] ABSTRACT

A rear bow sight includes a pair of spaced apart, parallel sighting line members mounted aft of the bow frame. When the shooter aims at a target, the bow is positioned so that the target appears between the sighting lines. The rear bow sight is adaptable for use in conjunction with different types of front bow sights, including front bow sights having a plurality of vertically spaced, horizontal pins. The sighting lines are used to position the bow so that respective sight beds of all of the pins appear between the sighting lines. When all of the sight beads of the front bow sight and the target are visible between the sighting line members, the bow is properly positioned for shooting at the target. A particular one of the forward sight beads is used to aim at the target depending upon the range to the target. The rear bow sight according to the present invention can be mounted on a cable guard or the like projecting rearwardly from the bow frame or, alternatively, a mounting plate can be used to mount the rear bow sight aft of the frame on bows without cable guards.

5 Claims, 1 Drawing Sheet

REAR BOW SIGHT

FIELD OF THE INVENTION

This invention relates to archery equipment and in particular to bow-mounted sights for improving shooting accuracy.

BACKGROUND OF THE INVENTION

An archery bow has long been recognized as a difficult weapon to fire with consistent accuracy. Conventional firing calls for the archer to sight the target by aiming along the shaft of the arrow. Depending on where the arrow falls in relation to the target, the archer will compensate accordingly. Compensation may be required for such factors as distance, wind, speed and size of the target. Due to the extreme difficulty of making these compensations, the need for a device by which the archer may accurately sight the target is well known in the art.

DESCRIPTION OF THE PRIOR ART

Various types of bow sights are known in the art. Many of these sights employ only a single sighting element or pin mounted adjacent to the bow. The archer uses the bow string or a sighting eyelet positioned in the bow string in conjunction with the sight pin to aim the arrow. One limitation of such sighting devices is that when the string is drawn close to the archer's eye, the archer will have a blurred view of the sight pin, which makes it difficult to accurately aim at the target. Another limitation is that each archer normally positions the drawn string in a slightly different relationship relative to his body, depending upon his own shooting style. Therefore, inaccurate and inconsistent shooting may result.

Other sighting devices use front and rear sights to facilitate aiming at the target. Examples of sighting devices using front and rear sights are shown in the following U.S. Pat. Nos.:

| | | |
|---|---|---|
| 2,909,167 | 2,982,026 | 3,245,393 |
| 3,271,863 | 3,648,376 | 4,162,579 |
| 4,417,403 | 4,535,544 | 4,570,352 |

Although sighting devices having front and rear sights are known in the art, many of these devices are not adapted for use with a multi-pin front sight, which is the most common and popular type of bow sight, and can be used only in conjunction with specially matched front and rear sights.

OBJECTS OF THE INVENTION

It is therefore the principal object of the present invention to provide an improved bow sight.

Another object of the invention is to provide an improved rear bow sight which can be used in conjunction with different types of front bow sights, including a conventional multi-pin bow sight.

Yet another object of the invention is to provide an improved rear bow sight which can be used either in connection with a front bow sight or by itself as a windage guide.

Still another object of the invention is to provide an improved rear bow sight which is attachable to a variety of bows.

A further object of the invention is to provide an improved bow sighting device which will allow the user to determine whether the bow is resting in substantially the same position each time the bow is drawn and aimed.

SUMMARY OF THE INVENTION

The foregoing and other objects are accomplished in accordance with the present invention wherein a sighting device for an archery bow having a frame and an arrow-impelling string attached to the frame is provided. The sighting device includes a pair of spaced apart, substantially parallel sighting lines and means for mounting the sighting lines relative to the frame, such that the sighting lines are substantially vertical when the bow is in a drawn position for shooting at a target. The bow is positioned so that the target appears between the sighting lines and the position of the target can be adjusted vertically according to the range of the target.

In accordance with one feature of the invention, the sighting device is a rear bow sight for cooperating with a front bow sight to help an archer's aim at the target. The sighting device is adaptable for use in conjunction with different types of front bow sights, including front bow sights having a plurality of vertically spaced, horizontal pins. When the bow is properly positioned, respective ends of all of the pins appear between the sighting lines. This enables the shooter to position the bow the same way each time, which enhances shooting accuracy and consistency.

In the preferred embodiment the rear bow sight is supported by a clamp member having a central opening for receiving a cable guard or the like projecting rearwardly from the bow frame. On bows without cable guards, a relatively flat plate member is attached at one end thereof to the frame and at the opposite end thereof to the rear sighting device, such that the plate member projects rearwardly from the frame. Means is provided for horizontally adjusting the sighting lines relative to the frame so that the sighting lines appear adjacent to an edge of the bow string when the bow is in a drawn position for shooting.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

Figure 1:
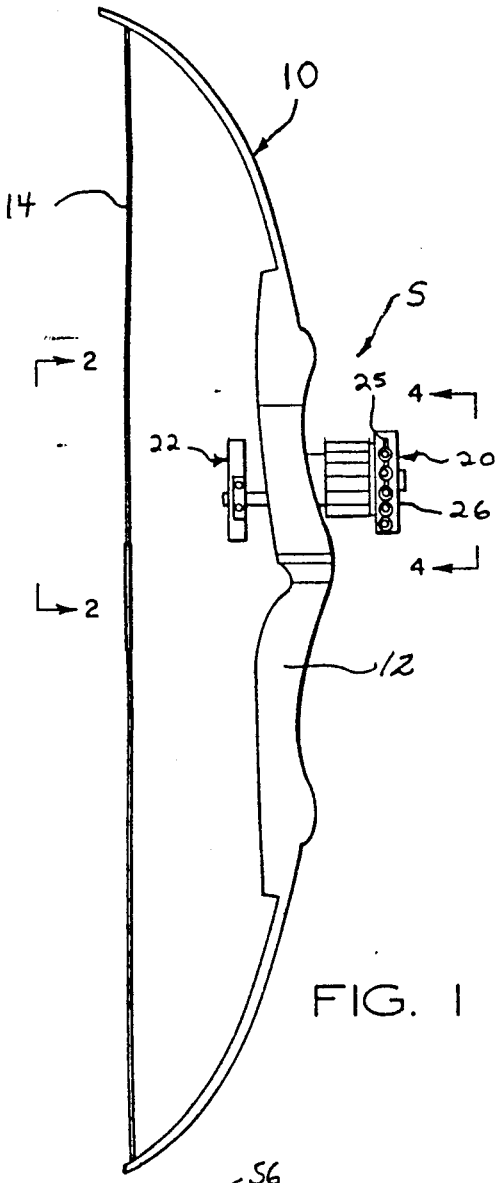
FIG. 1 is a side elevation view of an archery bow with a sighting device according to the present invention mounted thereon.

In the description which follows, like parts are marked throughout the specification and drawings with the same reference numerals, respectively. The drawings are not necessarily to scale and in some instances proportions have been exaggerated in order to more clearly depict certain features of the invention.

Figure 2:
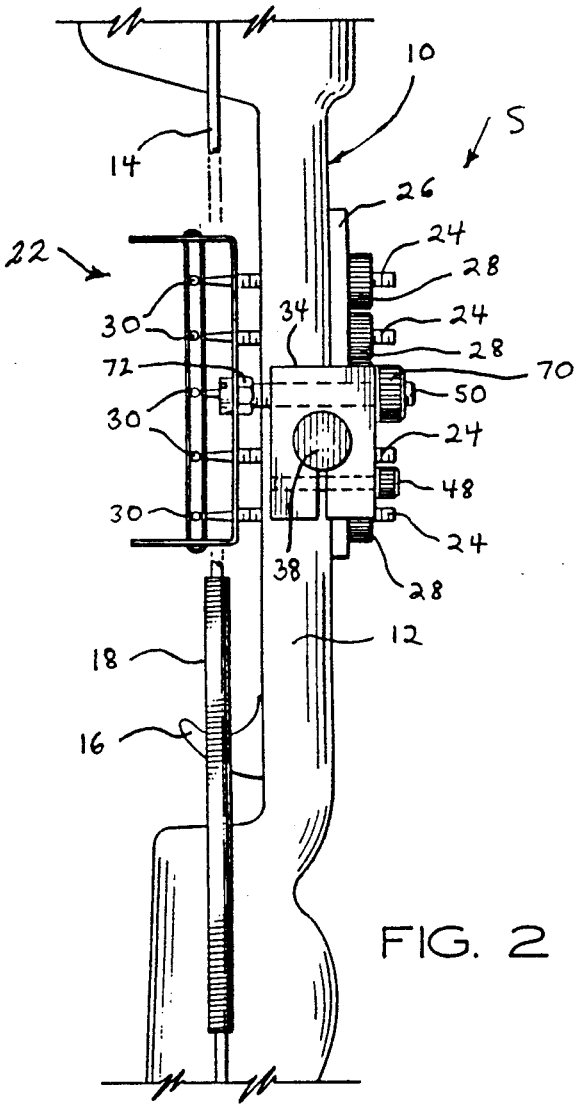
FIG. 2 is a rear elevation view of a portion of the bow of FIG. 1.

Referring to FIGS. 1 and 2, an archery bow 10 includes a curved frame member 12 and an arrow-impelling string 14, attached to frame member 12 adjacent to respective opposite ends thereof. As best seen in FIG. 2, frame member 12 includes an arrow rest 16, protruding therefrom for journally supporting an arrow (not shown) while the arrow is being aimed at a target. A central portion of string 14 is reinforced, as indicated at 18, to reduce wear in the area of string 14 where the notch at the end of the arrow fits on the string 14 and where the archer grips string 14.

In accordance with the preferred embodiment of the present invention, a sighting assembly S is mounted on a central portion of frame member 12. The sighting assembly includes a front sight 20 and a rear sight 22. Front sight 20 includes a plurality of sighting pins 24 extending through a vertical slotted portion 25 of a mounting member 26. Each pin 24 has threads which engage complementary threads in a corresponding adjustment nut 28, which is concentrically disposed on the shaft of the corresponding pin 24. A particular adjustment nut 28 is tightened to secure the corresponding pin 24 in a predetermined fixed position in a slot 25 of mounting member 26. Similarly, the adjustment nut 2B is loosened to adjust the position of the corresponding pin 24 vertically or horizontally.

Each pin 24 includes a sight bead 30 at one end thereof to help the shooter aim at the target. The individual beads 30 are aligned with the string 14, so that the archer can use a particular sight bead 30 corresponding to the range of the target and the trajectory which the arrow will follow to the target. For example, the uppermost sight bead 30 is used for aiming at shorter distance targets, while the lowermost sight bead 30 is used for aiming at longer distance targets. By adjusting the vertical positions of pins 24 within the slot 25 of mounting member 26, the vertical positions of the corresponding beads 30 are also adjusted to accommodate the desired shooting ranges. Mounting member 26 is preferably secured to frame member 12 at a fixed position forward of frame member 12, as shown in FIG. 1.

Figure 3:
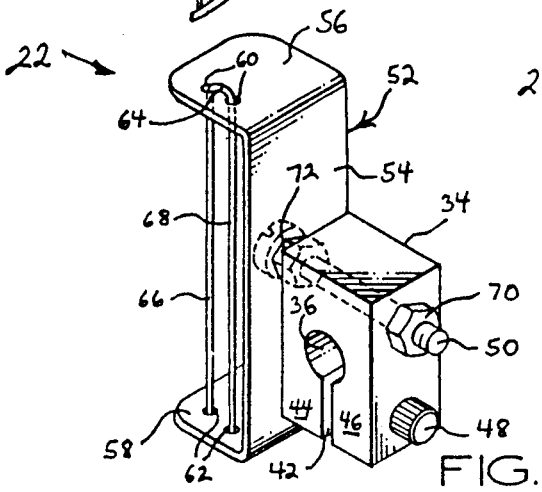
FIG. 3 is a perspective view of the sighting device according to the present invention.

Referring to FIGS. 2 and 3, the rear sight 22 includes a rectangular mounting clamp 34 having a central opening 36 extending therethrough. Rear sight 22 is mounted on bow 10 by positioning opening 36 on a cable guard 38 or the like, which extends rearwardly from frame member 12, as shown in FIGS. 1 and 2. Mounting clamp 34 is intersected by a vertical slot 42 beneath opening 36 for dividing a lower portion of mounting block 34 into separate sections 44 and 46. Rear sight 22 is preferably mounted at least one inch ahead of the bow cables (not shown) and approximately eight inches to the rear of front sight 20.

Mounting clamp 34 further includes a pair of openings (not shown) extending transversely therethrough for receiving respective threaded screws 48 and 50. The respective surfaces of clamp 34 surrounding the openings are threaded for engaging complementary threads on the screws 48 and 50, respectively. Screw 48 extends through the bottom transverse opening for connecting sections 44 and 46. When screw 48 is tightened, sections 44 and 46 are drawn together; whereas, when screw 48 is loosened, sections 44 and 46 are pushed apart. Mounting clamp 34, including sections 44 and 46, is preferably comprised of a resilient material, so that sections 44 and 46 will be pinched together by the tightening action of screw 48 and will separate when screw 48 is loosened. Screw 48 can be loosened to facilitate the placement of mounting clamp 34 on cable guard 38. When mounting clamp 34 is properly positioned thereon, screw 48 is tightened to secure mounting clamp 34 in a desired fixed position on cable guard 38.

Rear sight 22 is mountable on bows which do not have cable guards by means of a mounting plate (not shown) having openings at both ends thereof. One end of the plate is coupled to the frame member 12, such that the plate extends rearwardly therefrom. The opposite end of the plate is attached to rear sight 22, such that rear sight 22 is mounted in a fixed position aft of frame member 12.

Rear sight 22 further includes a bracket 52 having a relatively flat sidewall 54 with top and bottom flanges 56 and 58 depending therefrom. Top flange 56 has a pair of holes 60 which are in substantial vertical alignment with a corresponding pair of holes 62 in bottom flange 58. A flexible string is routed through both pairs of holes 60, 62 to define a substantially continuous loop 64 extending between top and bottom flanges 56 and 58. The string loop 64 is preferably made of nylon. However, other materials such as wire, metal strips or monofilament may be used to good advantage in the construction of the sighting line members 66, 68. Loop 64 defines two substantially parallel, vertical sighting line members 66 and 68 between top and bottom flanges 56 and 58. The sighting line members 66, 68 are held in tension by the top and bottom flanges 56, 58.

Sidewall 54 has a plurality of vertically spaced openings (not shown) for receiving screw 50. The position of bracket 52 can be adjusted vertically relative to clamp 34 by inserting screw 50 through a particular one of the plurality of openings in sidewall 54. The screw 50 is also used to adjust the position of bracket 52 horizontally relative to clamp 34. The screw 50 can be moved horizontally relative to clamp 34 by loosening jam nut 70 and rotating screw 50 in a predetermined direction. A second jam nut 72 holds bracket 52 in a fixed position on screw 50, so that bracket 52 will be moved horizontally, relative to clamp 34 along with screw 50, thereby adjusting the position of lines 66 and 68 horizontally, relative to frame member 12.

Figure 4:
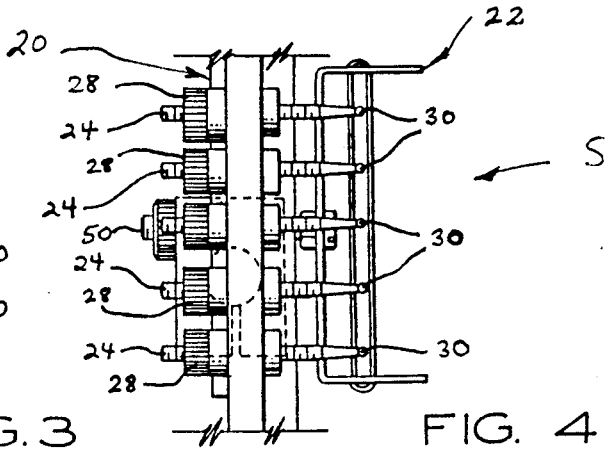
FIG. 4 is a front elevation view of the sighting device according to the present invention.

Referring to FIGS. 2 and 4, the bow 10 is positioned so that all of the beads 30 appear between the two vertical string segments 66 and 68 when the archer takes aim at a target. String segments 66 and 68 are preferably of a bright color to help the archer frame the beads 30. String segments 66 and 68 also help the archer determine that the bow is being aimed correctly. Slight side-to-side movements of the archer's wrist will twist the bow about a vertical axis, which can cause an inaccurate shot. When beads 30 appear between the vertical segments 66 and 68, the archer can determine that the bow is properly positioned each time, thereby significantly improving shooting accuracy and consistency. After all of the sight beads 30 are framed between string segments 66 and 68, the archer can then focus on a particular sight bead 30, depending upon the range to the target.

To position bow 10 for shooting, bow 10 is adjusted so that the archer has a clear view of the sight beads 30 between the vertical string segments 66 and 68 and also a clear view of the target. Beads 30 can be adjusted vertically and horizontally to the desired positions. After beads 30 are adjusted, the rear sighting lines 66 and 68 can also be adjusted vertically and horizontally. The adjustment is made with bow 10 at full draw to account for the torque in frame member 12 and for the shooter's particular manner of holding bow 10. The rear frame lines 66 and 68 are preferably positioned so that they appear adjacent to an edge of bow string 14 when the archer takes aim at the target, substantially as shown in FIG. 2. String 14 should not appear between frame lines 66 and 68, since this would obstruct the archer's view of beads 30 and the target and also tend to blur the shooter's vision. The string 14 can be positioned either just inside or just outside of frame lines 66 and 68, depending upon the archer's preference.

The rear sight 22 according to the present invention can be used in conjunction with a front sight, such as a conventional multi-pin front sight, or alternatively, the rear sight can be used by itself as a windage guide. The rear sight 22 is positioned a substantial distance in front of the shooter's eyes, thereby eliminating the blurring problem associated with string-mounted rear sights, such as the so-called "peep sight". The parallel, vertical lines of the rear sight frame the sight beads of the front sight to help the user clearly see the sight beads, particularly in low light conditions.

Various embodiments of the invention have been described in detail. Since it is obvious that many changes in and additions to the above-described preferred embodiment can be made without departing from the nature, spirit and scope of the invention, the invention is not limited to said details, except as set forth in the appended claims.

What is claimed is:

1. A rear sight assembly for use in combination with an archery bow of the type having a bow frame, an arrow-impelling string attached to the bow frame, and a front sight assembly mounted on the bow frame, the front sight assembly having aiming beads aligned along a straight line forward of the bow frame, the rear sight assembly comprising:

a support bracket having first and second flanges spaced apart in open relationship from each other and means mountable onto the bow frame for holding the flanges at a location aft of the bow frame, said mountable holding means and flanges defining a viewing window which is open on one side;

first and second sighting line members connected between the first and second flanges and disposed in substantially parallel alignment with each other, said sighting line members being held in tension by said first and second flanges.

2. A rear sight assembly as defined in claim 1, wherein the sighting line members are flexible string segments.

3. A rear sight assembly as defined in claim 1, wherein the sighting line members are wire segments.

4. A rear sight assembly as defined in claim 1, wherein the sighting line members are monofilament segments.

5. A rear sight assembly as defined in claim 1, wherein the sighting line members are metal strips.

* * * * *

UNITED STATES PATENT AND TRADEMARK OFFICE

CERTIFICATE OF CORRECTION

PATENT NO. : 5,040,301

DATED : August 20, 1991

INVENTOR(S) : Charles L. Forbis

It is certified that error appears in the above-identified patent and that said Letters Patent is hereby corrected as shown below:

Column 3, line 22, "adjustment nut 2B" should be -- adjustment nut 28 --.

Signed and Sealed this

Twenty-ninth Day of September, 1992

*Attest:*

DOUGLAS B. COMER

*Attesting Officer*

*Acting Commissioner of Patents and Trademarks*